US010286533B2

(12) United States Patent
Krout et al.

(10) Patent No.: US 10,286,533 B2
(45) Date of Patent: May 14, 2019

(54) DEPTH ADJUSTMENT MECHANISM FOR A FASTENING TOOL

(71) Applicant: BLACK & DECKER INC., New Britain, CT (US)

(72) Inventors: Daniel L. Krout, Abingdon, MD (US); James J. Kenney, Baltimore, MD (US)

(73) Assignee: Black & Decker Inc., New Britain, CT (US)

( * ) Notice: Subject to any disclaimer, the term of this patent is extended or adjusted under 35 U.S.C. 154(b) by 329 days.

(21) Appl. No.: 15/138,520

(22) Filed: Apr. 26, 2016

(65) Prior Publication Data

US 2016/0325420 A1 Nov. 10, 2016

Related U.S. Application Data

(60) Provisional application No. 62/158,814, filed on May 8, 2015.

(51) Int. Cl.
*B25C 1/00* (2006.01)

(52) U.S. Cl.
CPC ..... *B25C 1/008* (2013.01)

(58) Field of Classification Search
CPC ..... B21J 15/28
USPC ..... 173/47; 227/8
See application file for complete search history.

(56) References Cited

U.S. PATENT DOCUMENTS 4,739,915 A 4/1988 Cotta
5,685,473 A 11/1997 Shkolnikov et al.
6,581,815 B1 6/2003 Ho et al.
6,609,646 B2 8/2003 Miller et al.
6,648,202 B2 11/2003 Miller et al.
7,204,403 B2 4/2007 Kenney et al.
8,302,833 B2 11/2012 Gross et al.
8,347,978 B2 1/2013 Forster et al.
(Continued)

FOREIGN PATENT DOCUMENTS

EP 1798002 A1 6/2007
EP 1916067 A1 4/2008

OTHER PUBLICATIONS

Extended European Search Report in corresponding European Patent Application No. 16168508.6, dated Sep. 29, 2016.

*Primary Examiner* — Nathaniel C Chukwurah
(74) *Attorney, Agent, or Firm* — Harness, Dickey & Pierce, PLC

(57) ABSTRACT

A contact trip adjustment assembly includes a forward trip member, adjustment pinion, adjustment nut, adjustment knob, and spring. The forward trip member can engage a workpiece and include a plurality of threads disposed about a first axis. The forward trip member can be axially translatable along the first axis between preset and actuated positions. The adjustment pinion can be rotatably disposed about the first axis and include a first gear. The adjustment nut can be coupled to the adjustment pinion for common rotation about the first axis. The adjustment nut can be axially slidable relative to the adjustment pinion and can be threadably engaged with the threads of the forward trip member. The adjustment knob can be rotatably disposed about a second axis and can include a second gear meshingly engaged with the first gear. The spring can bias the forward trip member toward the preset position.

19 Claims, 5 Drawing Sheets

(56) References Cited

U.S. PATENT DOCUMENTS

| | | | | |
|---|---|---|---|---|
| 8,631,986 | B2 * | 1/2014 | Hlinka | B25C 1/06 173/11 |
| 2005/0023323 | A1 | 2/2005 | Jalbert et al. | |
| 2005/0217416 | A1 | 10/2005 | Berry et al. | |
| 2005/0218176 | A1 * | 10/2005 | Schell | B25C 1/008 227/8 |
| 2008/0099526 | A1 * | 5/2008 | Brendel | B25C 1/008 227/8 |
| 2013/0048696 | A1 | 2/2013 | Largo et al. | |
| 2013/0306699 | A1 | 11/2013 | Baskar et al. | |

* cited by examiner

DEPTH ADJUSTMENT MECHANISM FOR A FASTENING TOOL

CROSS-REFERENCE TO RELATED APPLICATIONS

This application claims the benefit of U.S. Provisional Application No. 62/158,814, filed on May 8, 2015. The entire disclosure of the above application is incorporated herein by reference.

FIELD

The present disclosure relates in general to the field of fastening tools and more particularly to mechanisms that adjust the depth to which a fastener can be driven into a workpiece.

BACKGROUND

This section provides background information related to the present disclosure which is not necessarily prior art.

Fastening tools, such as power nailers and staplers, are relatively common place in the construction trades. Often times, however, the fastening tools that are available may not provide the user with a desired degree of flexibility and freedom due to the presence of hoses and other attachments that couple the fastening tool to a source of pneumatic power. Similarly, many features of typical fastening tools, such as a contact trip assembly, while adequate for their intended purpose, do not provide the user with the most efficient and effective function. Accordingly, there remains a need in the art for an improved fastening tool.

SUMMARY

This section provides a general summary of some aspects of the present disclosure and is not a comprehensive listing or detailing of either the full scope of the disclosure or all of the features described therein.

In one form, a contact trip adjustment assembly for a tool configured to drive a fastener into a workpiece is provided. The contact trip adjustment assembly includes a forward trip member, an adjustment pinion, an adjustment nut, an adjustment knob, and a spring. The forward trip member can be adapted to engage the workpiece and can include a plurality of threads disposed about a first axis. The forward trip member can be axially translatable along the first axis between a preset position and an actuated position. The adjustment pinion can be rotatably disposed about the first axis and can include a first geared portion. The adjustment nut can be coupled to the adjustment pinion for common rotation about the first axis. The adjustment nut can be axially slidable relative to the adjustment pinion and can have a plurality of mating threads that are threadably engaged with the threads of the forward trip member. The adjustment knob can be rotatably disposed about a second axis that is not coincident with the first axis. The adjustment knob can include a second geared portion that can be meshingly engaged with the first geared portion. The spring can bias the forward trip member toward the preset position.

In one form, a tool for driving a fastener into a workpiece is provided. The tool includes a housing, a linear motor, a contact trip assembly, a trigger, a contact trip switch, and a control module. The drive mechanism can be coupled to the housing and can be adapted to drive the fastener in a forward direction. The contact trip assembly can include an adjustment knob, an adjustment pinion, and a forward trip member. The adjustment knob can be coupled to the housing and can be rotatable relative to the housing about a first axis. The adjustment knob can include an input portion that can be disposed exterior of the housing on a first side of the housing. The adjustment pinion can be coupled to the housing and can be rotatable relative to the housing about a second axis that is not coincident with the first axis. The adjustment pinion can be coupled to the adjustment knob to receive input torque therefrom. The forward trip member can be coupled to the adjustment pinion such that rotation of the adjustment knob in the forward direction, as viewed from the first side of the housing, can translate the forward trip member in a rearward direction. Translation of the forward trip member relative to the housing in the rearward direction by a predetermined distance can actuate the contact trip switch. The control module can be configured to operate the drive mechanism to drive the fastener when both the trigger and the contact trip switch are actuated.

In one form, a tool for driving a fastener into a workpiece is provided. The tool includes a housing, a linear motor, a contact trip assembly, a trigger, a contact trip switch, and a control module. The drive mechanism can be disposed within the housing and can be adapted to drive the fastener into the workpiece. The contact trip assembly can include an adjustment knob, an adjustment pinion, a forward trip member, an adjustment nut, and a spring. The adjustment knob can be coupled to the housing and can be rotatable relative to the housing about a first axis. The adjustment knob can include an input portion and a first geared portion. The adjustment pinion can be coupled to the housing and can be rotatable relative to the housing about a second axis that is not coincident with the first axis. The adjustment pinion can include a second geared portion that can be meshingly engaged with the first geared portion. The forward trip member can be axially translatable along the second axis relative to the housing between a preset position and an actuated position. The adjustment nut can be coupled to the adjustment pinion for common rotation therewith. The adjustment nut can be axially slidable relative to the adjustment pinion. The adjustment nut can be threadably engaged to the forward trip member. The spring can bias the forward trip member toward the preset position. When the forward trip member is in the actuated position, the contact trip switch can be actuated. The control module can be configured to operate the drive mechanism to drive the fastener when both the trigger and the contact trip switch are actuated.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
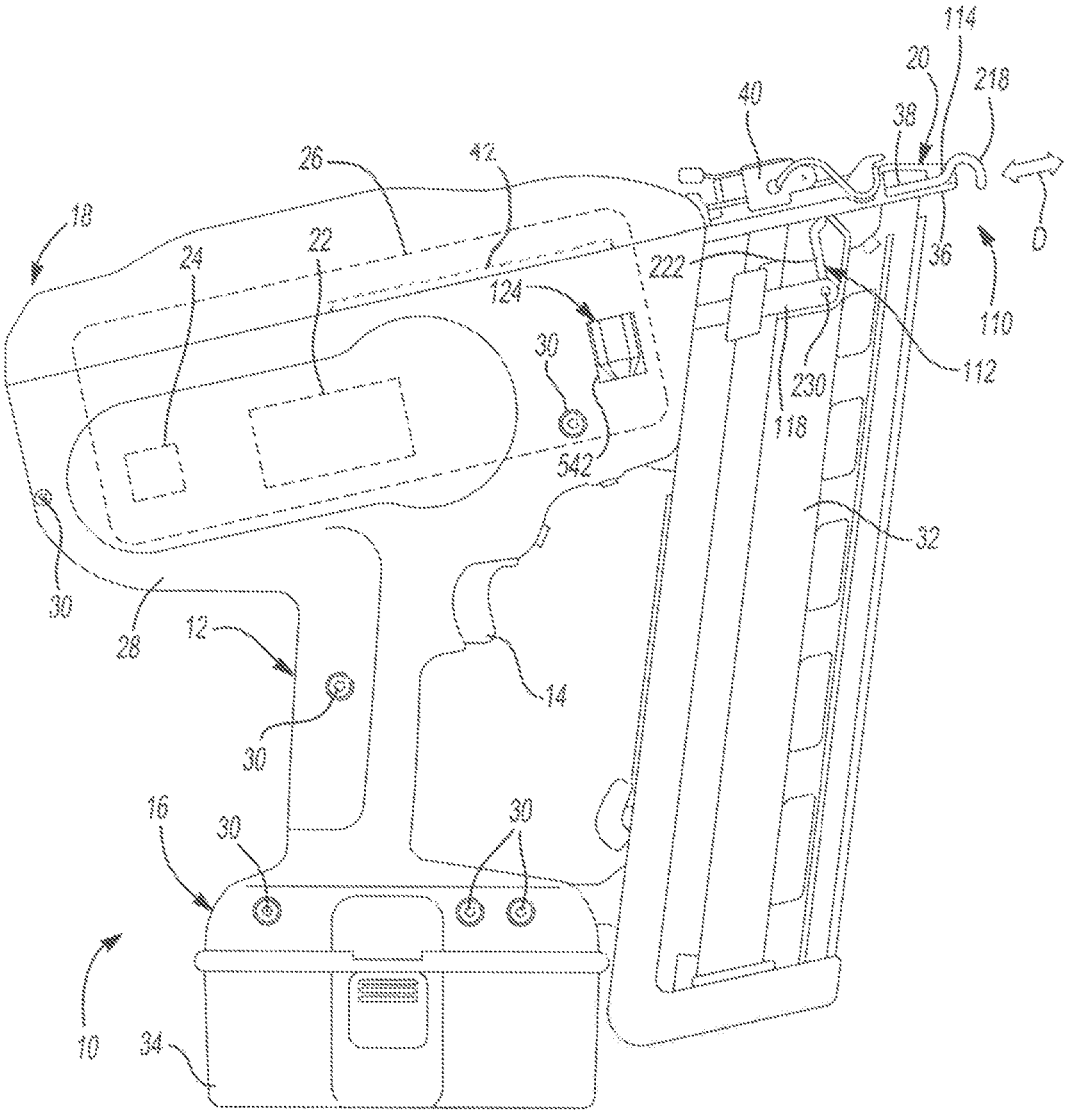
FIG. 1 is a side elevation view of an example of a fastening tool constructed in accordance with the teachings of the present disclosure.

Example embodiments will now be described more fully with reference to the accompanying drawings. The following description is merely exemplary in nature and is in no way intended to limit the present teachings, application, or uses. Throughout this specification, like reference numerals will be used to refer to like elements.

Referring now more particularly to the drawings, FIG. 1 illustrates a fastening tool 10 constructed in accordance with the teachings of the present invention. The tool 10 can include a handle assembly 12, a trigger 14, a base 16, a main body portion 18, a nose assembly 20, a linear motor 22, and a contact trip assembly 110. In the example provided, the tool 10 also includes a control module 24. In the example provided, the handle assembly 12, base 16, and main body portion 18 are in the form of a frame 26 and a two-piece housing 28 that can be fastened together by screws 30 or the like. As shown in FIG. 1, a magazine 32 can extend between the base 16 and the front of the main body portion 18. A power source 34, such as a battery can be mounted to the base 16 so that the tool 10 can be used as a cordless tool 10. It should be noted, however, that the tool 10 should not be limited to just the cordless configuration. More particularly, the tool 10 can be powered by an AC power source through a power cord, pneumatically powered by air or the like, powered by internal combustion, or any other power source known in the art.

Figure 2:
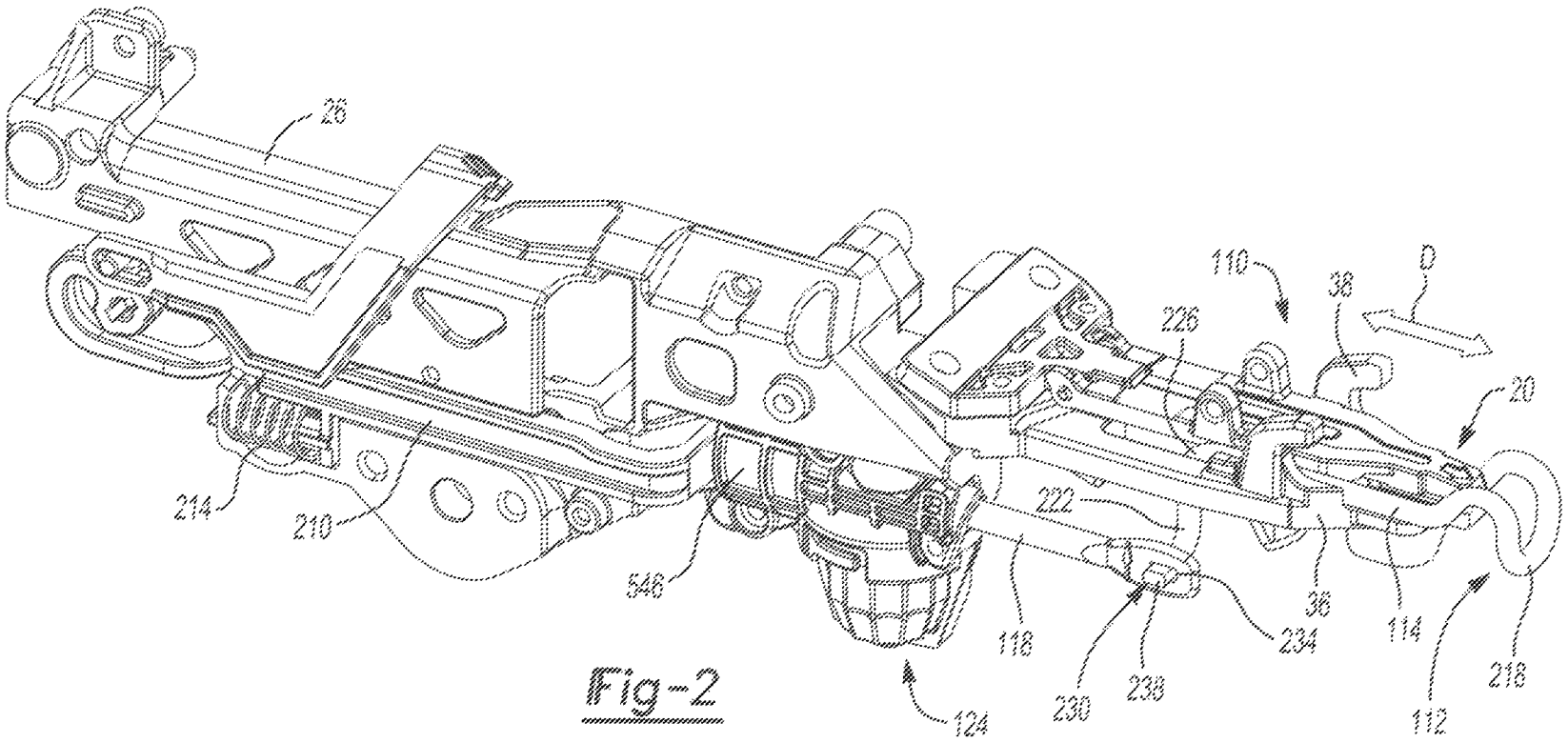
FIG. 2 is a perspective view of a portion of the tool of FIG. 1, illustrating a frame and a contact trip assembly of the tool.

The nose assembly 20 can be disposed at a top of the magazine 32 and the front of the main body portion 18. As best shown in FIG. 2, the nose assembly 20 can be mounted to the frame 26. Returning to FIG. 1, the magazine 32 can hold fasteners, such as nails or staples for example. The nose assembly 20 can include a nosepiece 36 that guides the fasteners toward a workpiece (not shown) when the tool 10 is discharged, and a nose cover 38 that can be pivotably connected to the nosepiece 36 so that the nose cover 38 may be opened if a fastener becomes jammed in the nosepiece 36. The nose cover 38 can be secured to the nosepiece 36 by a latch assembly 40.

The linear motor 22 can be disposed within the housing 28 and mounted to the frame 26. The linear motor 22 can include a driver 42 that can be configured to drive the fastener from the nosepiece 36 into the workpiece. The linear motor 22 can be any suitable mechanism for moving the driver 42 linearly along the fore-aft direction of the tool 10 (i.e., indicated by arrow "D") for driving the fastener. For example, the linear motor 22 can be similar to those described in U.S. Application Pub. Nos. 2013-0306699-A1, 2013-0048696-A1, or U.S. Pat. Nos. 8,347,978, 6,648,202, 6,609,646, 4,739,915 the entire disclosures of which are incorporated herein by reference, though other configurations can be used.

The control module 24 can be configured to determine an operational state of the tool 10 and actuate the linear motor 22 to drive the fastener into the workpiece if a predetermined set of conditions is met. For example, the control module 24 can have any number of suitable modes, such as sequential firing, or bump firing. The control module 24 can receive signals from the trigger 14, the linear motor 22, and the contact trip assembly 110 to determine the operational state of the tool 10, and can output a control signal to the linear motor 22 to actuate the linear motor 22. In general, the control module 24 can be configured to not permit the linear motor 22 to actuate unless both the contact trip assembly 110 is pressed against the workpiece, and the trigger is actuated. The control module 24 is described in greater detail below.

Figure 3:
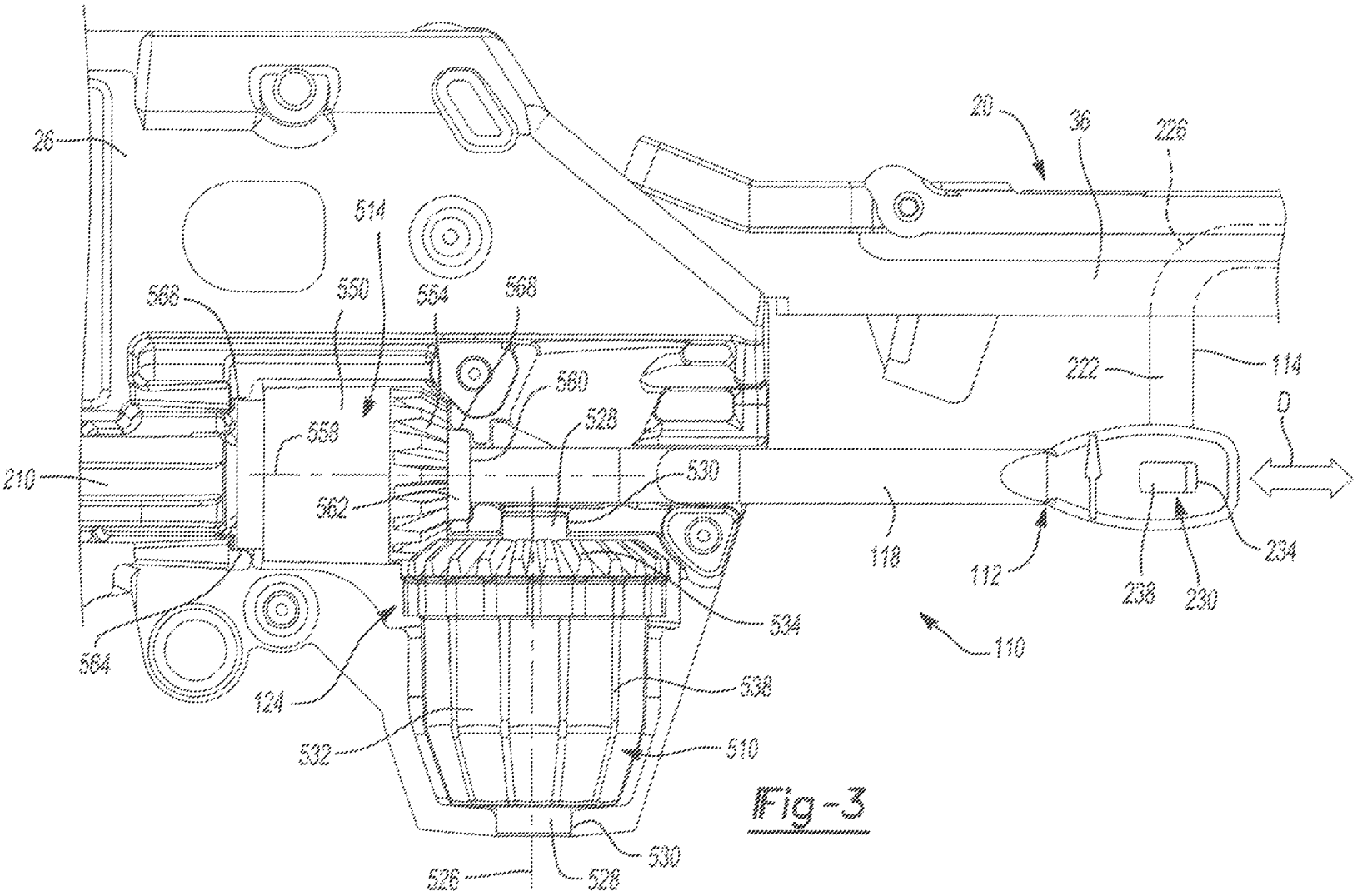
FIG. 3 is a side elevation view of a portion of a depth adjustment mechanism of the contact trip assembly of FIG. 2.

With continued reference to FIG. 1 and additional reference to FIGS. 2-3, the contact trip assembly 110 can include a lower or forward trip member 112, a depth adjustment mechanism 124, an upper or rear contact trip member 210, and a biasing member 214. In the example provided, the forward trip member 112 includes a contact member 114 and an intermediate link member 118. The contact trip assembly 110 can extend forward from the nosepiece 36 and can generally be configured to prevent the tool 10 from inadvertent actuation (e.g., inadvertent firing of a fastener).

The contact member 114 can extend slidably through the nosepiece 36 and outward therefrom to extend forward beyond the nosepiece 36. Preferably, the contact member 114 is formed of a heavy wire or rod that is tough and rigid so that the contact member 114 is long-lasting and durable when repeatedly impacted against the workpiece during use of the tool 10. One preferable material to form the contact member 114 from is a high-carbon spring steel. By utilizing such a material, the contact member 114 is not easy to bend, but still provides a good sliding surface against the nosepiece 36 when the contact member 114 is engaged against a workpiece. It should be understood, however, that any material known in the art that provides rigidity and toughness, as well as a good sliding surface may be used to form the contact member 114.

A portion of the contact member 114 that extends outward from the nosepiece 36 can be a curved portion 218 that can loop rearwardly toward the handle assembly 12 and base portion 16 of the tool 10. Since the curved portion 218 in the example provided loops rearwardly, the contact member 114 will not impede a user's line of sight when using the tool 10. Further, the curved design of the contact member 114 enables the tool 10 to keep good penetration performance when the tool is rotated off a perpendicular axis of the workpiece. That is, when the tool 10 is angled against a workpiece, the curved portion 218 allows the contact trip assembly 110 to keep good contact with the workpiece, which in turn allows the tool 10 to maintain a desired penetration depth of the fastener into the workpiece when the tool 10 is discharged.

The contact member 114 can also include an arm portion 222 that is connected to the link member 118 of the contact trip assembly 110. The arm portion 222 of the contact member 114 can begin at an elbow portion 226 of the contact member 114 that connects the curved portion 218 and arm portion 222. In the example provided, the arm portion 222 can extend downward along the magazine 32 at approximately a right angle (90°) from the curved portion 218 of the contact member 114, though other configurations can be used.

The arm portion 222 can be non-rotatably connected to the link member 118. In the example provided, the arm portion 222 is connected to the link member 118 by way of a rectangular-shaped joint 230 including a rectangular-shaped slot 234 of the link member 118 and a rectangular-shaped or flattened end 238 of the arm portion 222 received in the rectangular-shaped slot 234, though other configurations can be used. In this manner, the contact member 114 and link member 118 are coupled for common translation along the fore-aft direction of the tool 10 (i.e., indicated by arrow "D"), as can occur when engaging the contact member 114 against a workpiece. In an alternative configuration, the contact member 114 and the link member 118 can be unitarily formed of a single piece of material or can be fixedly coupled together in any other suitable manner.

The link member 118 of the contact trip assembly 110 can extend rearward from the nose assembly 20 into the housing 28 of the tool 10. In the example provided, the link member 118 can extend into the frame 26. The link member 118 can be a round rod-shaped member and can be formed of a metal such as steel or aluminum, though other configurations or materials can be used. The link member 118 is described in greater detail below.

With specific reference to FIG. 3, the contact trip assembly 110 is shown including portions of the contact trip assembly 110 located within the housing 28 (FIG. 1) and within the frame 26. Within the frame 26, the depth adjustment mechanism 124 can couple the link member 118 to the rear contact trip member 210. The depth adjustment mechanism 124 is described in greater detail below, but can generally be operable to selectively move the link member 118 in the fore-aft direction (i.e., arrow "D") relative to the rear contact trip member 210 and relative to the frame 26. Thus the depth adjustment mechanism 124 can effectively adjust the total length of the contact trip assembly 110 and the distance that the contact member 114 extends forward of the nose assembly 20.

Figure 4:
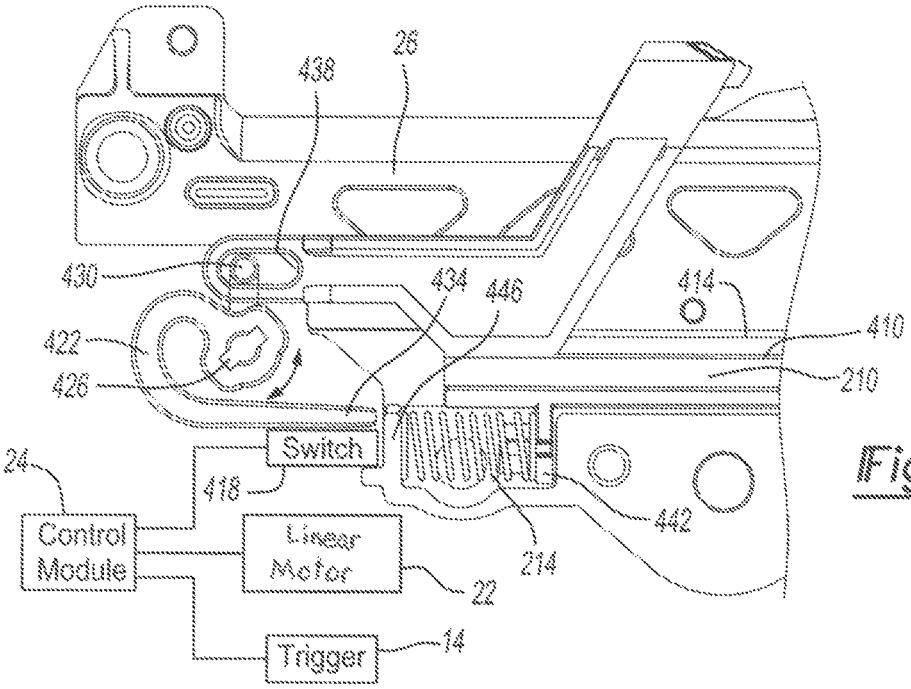
FIG. 4 is a side elevation view of a different portion of the contact trip assembly of FIG. 2.

With additional reference to FIG. 4, the rear contact trip member 210 can include a rail member 410. The rail member 410 can extend from the depth adjustment mechanism 124 toward the rear of the frame 26 and can be slidably engaged with the frame 26. In the example provided, the rail member 410 is slidably received in a track or recess 414 defined by the frame 26 that can extend lengthwise along the frame 26 to permit the rear contact trip member 210 to slide in the fore-aft direction (i.e., arrow "D") relative to the frame 26 and the housing 28 (FIG. 1).

The rear contact trip can be configured to actuate a switch 418 that can send a signal to the control module 24 indicative of the position of the contact trip assembly 110. In the example provided, a switch member 422 can be rotatably coupled to the housing 28 (FIG. 1) or the frame 26 to rotate about a pivot 426. The switch member 422 can include a pin 430 and a lever 434. A rear end of the rear contact trip member 210 can define a slot 438, in which the pin 430 can be slidably received. The lever 434 can be fixedly coupled to the pin 430 and positioned such that rotation of the switch member 422 can cause the lever 434 to actuate the switch 418. The switch 418 can be any suitable type of switch, such as a microswitch or a Hall Effect sensor for example. Thus, the switch member 422 can be actuated when the rear contact trip member 210 is axially translated a distance greater than a predetermined threshold distance.

The biasing member 214 can bias the rear contact trip member 210, and thus, the contact member 114, in the forward direction. In the example provided, the biasing member 214 is a compression coil spring and the rear contact trip member 210 can include a platform 442 that can be fixedly coupled to and extend from the rail member 410. The biasing member 214 can be disposed between the platform 442 and a protrusion 446 of the frame 26 or the housing 28 (FIG. 1) such that movement of the rear contact trip member 210 in the aft or rearward direction compresses the biasing member 214 between the platform 442 and the protrusion 446 to bias the rear contact trip member 210 in the forward direction.

Figure 6:
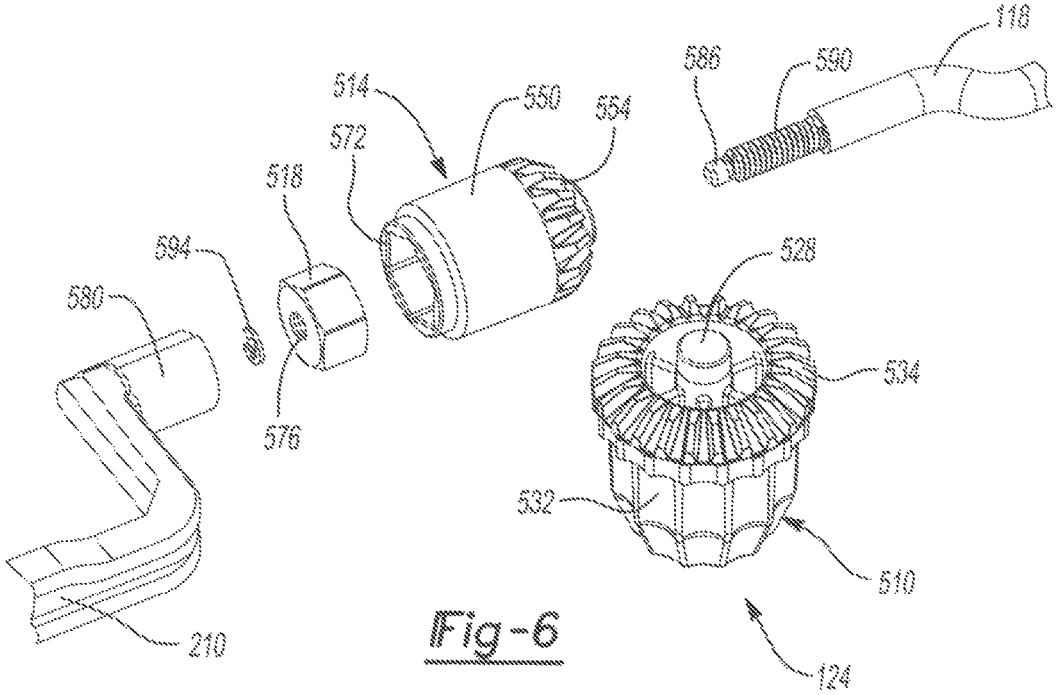
FIG. 6 is an exploded perspective view of a portion of the depth adjustment mechanism of FIG. 3.
Figure 5:
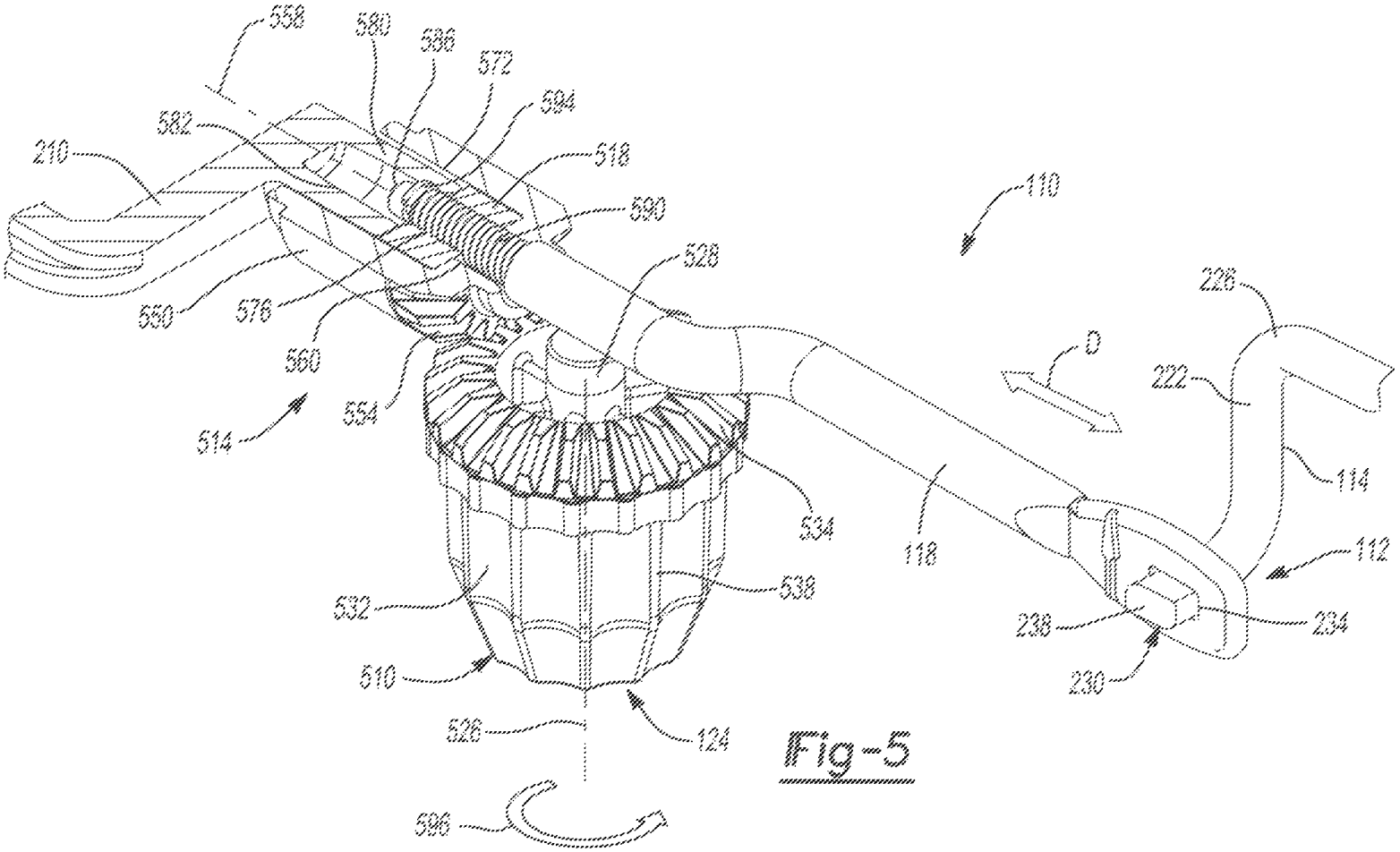
FIG. 5 is a partial sectional perspective view of a portion of the depth adjustment mechanism of FIG. 3.

With reference to FIGS. 3, 5, and 6 the depth adjustment mechanism 124 can include an adjustment knob 510, an adjustment pinion 514, and an adjustment nut 518. The adjustment knob 510 can be mounted to the frame 26 for rotation relative thereto about a first axis 526. In the example provided, the adjustment knob 510 is supported within the frame 26 by a central post 528. The central post 528 can extend axially outward from both axial ends of the adjustment knob 510 and be rotatably received in a cradle portion 530 of the frame 26, such that the adjustment knob 510 does not translate relative to the frame 26, but can rotate about the first axis 526.

The adjustment knob 510 can include an input portion 532 and a geared portion 534 fixedly coupled to the input portion 532 for common rotation about the first axis 526. In the example provided, the input portion 532 and the geared portion 534 are fixedly coupled to the central post 528. In the example provided, the geared portion 534 is a bevel gear and the first axis 526 is transverse (e.g., generally perpendicular) to the fore-aft direction (arrow "D") of the tool 10.

The input portion 532 can extend outward or external of the housing 28 (FIG. 1) such that a user (not shown) can easily rotate the adjustment knob 510 by hand. In the example provided, the input portion 532 includes a plurality of ridges 538 that extend longitudinally along the input portion 532 and are spaced apart circumferentially about the input portion 532 to allow the user to more easily grip and rotate the adjustment knob 510. In the example provided the input portion 532 is accessible from outside of the housing 28 via an aperture 542 (FIG. 1) defined by the housing 28 (FIG. 1), while the geared portion 534 is disposed entirely within the housing 28 (FIG. 1) and is enclosed by a cover portion 546 (FIG. 2) of the frame 26. In the example provided, the aperture 542 is only on the right side of the housing 28, such that the input portion 532 only extends through the right side of the housing 28 and is not accessible from the left side of the housing 28, though other configurations can be used.

The adjustment pinion 514 can have a sleeve portion 550 and a geared portion 554 fixedly coupled to the sleeve portion 550 for common rotation about a second axis 558 that is transverse (e.g., perpendicular) to the first axis 526. The adjustment pinion 514 can be mounted within the frame 26 for rotation relative thereto about the second axis 558. In the example provided, the geared portion 554 is a bevel gear and is meshingly engaged with the geared portion 534 of the adjustment knob 510. In the example provided, the geared portion 534 of the adjustment knob 510 has a larger diameter (i.e., has a greater number of gear teeth) than the geared portion 554 of the adjustment pinion 514, though other configurations can be used. The adjustment pinion 514 can also include a cylindrical port 560 that can extend through the geared portion 554 and can include a cylindrical shoulder 562 that is centered on the second axis 558 and forward of the geared portion 554.

In the example provided, the adjustment pinion 514 is mounted within the frame 26, such that the adjustment pinion 514 does not translate relative to the frame 26, but can rotate about the second axis 558. Thus, the geared portions 534 and 554 can remain meshingly engaged at all times. In the example provided, the sleeve portion 550 has a generally cylindrical outer surface, centered on the second axis 558, that has a first diameter proximate to the geared portion 554, and a second diameter, which is smaller than the first diameter and distal to the geared portion 554. In this way, the sleeve portion 550 includes a cylindrical step 564, such that the step 564 and the shoulder 562 can be received in a cradle portion 568 of the frame 26 to prevent the adjustment pinion 514 from translating relative to the frame 26, while permitting rotation about the second axis 558.

The sleeve portion 550 can also define an internal cavity 572 centered on the second axis 558. The internal cavity 572 can be open to the port 560 and open at the rear end of the adjustment pinion 514. The internal cavity 572 can have a segmented or keyed shape. In the example provided, the internal cavity 572 has a hexagonal shape, though other configurations can be used. For example, the internal cavity 572 can have one or more flat sides, splines, or another shape that can engage a mating external shape of the adjustment nut 518 to permit axial sliding of the adjustment nut 518 relative to the sleeve portion 550, while preventing relative rotation therebetween. In the example provided, the internal cavity 572 is a hexagonal cavity and the adjustment nut 518 is a hex nut, having a hexagonal external shape. Thus, the adjustment nut 518 can be non-rotatably, but axially slidably disposed relative to the adjustment pinion 514, within the internal cavity 572. The adjustment nut 518 can include a plurality of internal threads 576 that extend about the second axis 558 and through the center of the adjustment nut 518.

The forward end of the rear contact trip member 210 can have a guide portion 580 that can be received in the internal cavity 572 such that the sleeve portion 550 can rotate relative to the guide portion 580 while the guide portion 580 can slide axially within the sleeve portion 550. The forward side of the guide portion 580 can abut the rearward side of the adjustment nut 518 within the internal cavity 572. In the example provided, the guide portion 580 has a cylindrical outer surface centered on the second axis 558 and has a diameter such that the guide portion 580 can slide axially within the internal cavity 572, while allowing the adjustment pinion 514 to rotate about the guide portion 580. The guide portion 580 can define a receiving cavity 582 that can be open to the forward end of the guide portion 580 and centered on the second axis 558.

A rear end 586 of the link member 118, i.e., axially opposite to the rectangular-shaped slot 234, can be coaxial with the second axis 558 and received through the port 560 of the adjustment pinion 514. The rear end 586 can define a plurality of external threads 590 that can be threadably engaged with the internal threads 576 of the adjustment nut 518. Thus, when the contact member 114 is pressed against a workpiece, the contact member 114 can translate the link member 118, which translates the adjustment nut 518. The adjustment nut 518 can push axially on the guide portion 580 to translate the rear contact trip member 210 rearward to actuate the contact trip switch 418 (FIG. 4).

In operation, rotation of the adjustment knob 510 can rotate the adjustment pinion 514, which can rotate the adjustment nut 518. Rotation of the adjustment nut 518 can cause axial translation of the link member 118 in the fore-aft direction (arrow "D"). The rear end 586 of the link member 118 can extend rearward of the adjustment nut 518 and into the receiving cavity 582 of the rear contact trip member 210. In the example provided, a retaining clip 594 can be attached to the rear end 586 of the link member 118 to prevent the adjustment nut 518 from rotating to the extent that the rear end 586 of the link member 118 would exit the adjustment nut 518. In the example provided, the retaining clip 594 is an "E-clip," though other configurations can be used.

In the example provided, the internal and external threads 576, 590 are left handed threads such that when the user rotates the input portion 532 in the rotational direction shown by arrow 596, i.e., forward when viewed through the aperture 542 (FIG. 1) on the right side of the housing 28 (FIG. 1), the contact member 114 is translated axially rearward. In the example provided, the internal and external threads 576 and 590 are double lead threads, though other configurations can be used. The contact trip switch 418 (FIG. 4) can be actuated with the nosepiece 36 closer to the workpiece when the contact member 114 is more axially rearward. Thus, rotating the adjustment knob 510 forward can increase the distance that the fastener is driven into the workpiece.

Similarly, when the user operates the input portion 532 to rotate the adjustment knob 510 in the opposite direction, i.e., rearward, the contact member 114 is translated axially forward to reduce the distance that the fastener is driven into the workpiece. Thus, the rotational direction of the adjustment knob 510 can correlate in an intuitive manner to the distance that the fastener is driven into the workpiece. In an alternative configuration, the aperture 542 (FIG. 1) can be located on the left side of the housing 28 (FIG. 1), instead of the right side as shown, and the threads 576, 590 can be right-handed threads, such that rotating the adjustment knob 510 when viewed from the left side of the tool 10 has a similar intuitive effect.

Alternatively, the correlation between the handedness of the threads 576, 590 and the location of the aperture 542 can be reversed, such that rotating the adjustment knob 510 forward can correlate to moving the contact member 114 forward, instead of correlating to an increased driving distance into the workpiece.

Besides the intuitive depth control and ease of operation via the relatively large input portion 532 of the adjustment knob 510, the construction of the depth adjustment mechanism 124 minimizes the complexity and number of parts required to adjust the position of the contact member 114. Furthermore, the adjustment knob 510 remains in one location relative to the housing 28 and can be positioned near the nosepiece 36 such that it is located in a user visibility-friendly area of the tool. Thus, the user can rotate the adjustment knob 510 while viewing the degree of movement of the contact member 114. The depth adjustment mechanism 124 of the present teachings also permits the precision of the depth adjustment to be easily tailored by adjusting the pitch of the internal and external threads 576, 590.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made and equivalents may be substituted for elements thereof without departing from the scope of the present disclosure. Furthermore, the mixing and matching of features, elements and/or functions between various examples is expressly contemplated herein, even if not specifically shown or described, so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

In this application, including the definitions below, the term "module" or the term "controller" may be replaced with the term "circuit." The term "controller" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The controller may include one or more interface circuits. In some examples, the interface circuits may include wired or wireless interfaces that are connected to a local area network (LAN), the Internet, a wide area network (WAN), or combinations thereof. The functionality of any given controller of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

What is claimed is:

1. A contact trip adjustment assembly for a tool configured to drive a fastener into a workpiece, the contact trip adjustment assembly comprising:

a forward trip member adapted to engage the workpiece and including a plurality of threads disposed about a first axis, the forward trip member being axially translatable along the first axis between a preset position and an actuated position;

an adjustment pinion rotatably disposed about the first axis and including a first geared portion;

an adjustment nut coupled to the adjustment pinion for common rotation about the first axis, the adjustment nut being axially slidable relative to the adjustment pinion and having a plurality of mating threads that are threadably engaged with the threads of the forward trip member;

an adjustment knob rotatably disposed about a second axis that is not coincident with the first axis, the adjustment knob including a second geared portion meshingly engaged with the first geared portion; and a spring biasing the forward trip member toward the preset position, where the first and second geared portions are bevel gears.

2. The contact trip adjustment assembly of claim 1, wherein the adjustment pinion defines an internal cavity and the adjustment nut is disposed within the internal cavity, wherein the adjustment nut includes at least one surface and the internal cavity includes at least one mating surface that engages the at least one surface of the adjustment nut to couple the adjustment nut for common rotation with the adjustment pinion while permitting the adjustment nut to slide axially within the internal cavity.

3. The contact trip adjustment assembly of claim 1, further comprising a rear trip member axially translatable along the first axis relative to the adjustment pinion, the adjustment pinion being rotatable relative to the rear trip member, wherein the rear trip member is linked to the adjustment nut to be translated therewith in a rear axial direction.

4. The contact trip adjustment assembly of claim 3, wherein the spring engages the rear trip member to bias the rear trip member toward the forward trip member.

5. The contact trip adjustment assembly of claim 3, wherein the adjustment pinion defines an internal cavity and the adjustment nut is disposed within the internal cavity, wherein the adjustment nut includes at least one surface and the internal cavity includes at least one mating surface that engages the at least one surface of the adjustment nut to couple the adjustment nut for common rotation with the adjustment pinion while permitting the adjustment nut to slide axially within the internal cavity, wherein a forward portion of the rear trip member abuts the adjustment nut in the internal cavity.

6. The contact trip adjustment assembly of claim 1, wherein the threads of the forward trip member and the mating threads of the adjustment nut are left-handed threads.

7. A tool for driving a fastener into a workpiece, the tool comprising:

a housing;

a linear motor coupled to the housing and adapted to drive the fastener in a forward direction;

a trigger;

a contact trip assembly including:

an adjustment knob coupled to the housing and rotatable relative to the housing about a first axis, the adjustment knob including an input portion that is disposed exterior of the housing on a first side of the housing;

an adjustment pinion coupled to the housing and rotatable relative to the housing about a second axis that is not coincident with the first axis, the adjustment pinion being coupled to the adjustment knob to receive input torque therefrom; and a forward trip member coupled to the adjustment pinion such that rotation of the adjustment knob in the forward direction, as viewed from the first side of the housing, translates the forward trip member in a rearward direction;

a contact trip switch, wherein translation of the forward trip member relative to the housing in the rearward direction by a predetermined distance actuates the contact trip switch; and an adjustment nut that is non-rotatably but axially slidably coupled to the adjustment pinion, the adjustment nut being threadably engaged to the forward trip member;

wherein the forward trip member and the adjustment rut are threadably engaged by a set of left-handed threads.

8. The tool of claim 7, wherein the adjustment pinion defines an internal cavity and the adjustment nut is disposed within the internal cavity, wherein the adjustment nut includes at least one surface and the internal cavity includes at least one mating surface that engages the at least one surface of the adjustment nut to couple the adjustment nut for common rotation with the adjustment pinion while permitting the adjustment nut to slide axially within the internal cavity.

9. The tool of claim 8, further comprising a rear trip member axially translatable along the second axis relative to the adjustment pinion, the adjustment pinion being rotatable relative to the rear trip member, wherein the rear trip member is linked to the adjustment nut for axial movement therewith in the rearward direction along the second axis.

10. The tool of claim 9, further comprising a spring biasing the rear trip member in a forward axial direction.

11. The tool of claim 9, wherein a forward portion of the rear trip member abuts the adjustment nut within the internal cavity.

12. The tool of claim 7, wherein the adjustment knob includes a first geared portion and the adjustment pinion includes a second geared portion meshingly engaged with the first geared portion.

13. The tool of claim 12, wherein the first and second geared portions are bevel gears.

14. The tool of claim 12, wherein when the forward trip member translates axially, the first and second geared portions remain meshingly engaged.

15. A tool for driving a fastener into a workpiece, the tool comprising:

a housing;

a linear motor disposed within the housing and adapted to drive the fastener along a drive axis into the workpiece;

a trigger;

a contact trip assembly including:

an adjustment knob coupled to the housing and rotatable relative to the housing about a knob axis that is perpendicular to the drive axis, the adjustment knob including an input portion and a first geared portion;

an adjustment pinion coupled to the housing and rotatable relative to the housing about a pinion axis that is parallel with the drive axis, the adjustment pinion including a second geared portion meshingly engaged with the first geared portion;

a forward trip member axially translatable along the second axis relative to the housing between a preset position and an actuated position;

an adjustment nut coupled to the adjustment pinion for common rotation therewith, the adjustment nut being axially slidable relative to the adjustment pinion, the adjustment nut being threadably engaged to the forward trip member; and a spring biasing the forward trip member toward the preset position; and a contact trip switch, wherein when the forward trip member is in the actuated position, the contact trip switch is actuated.

16. The tool of claim 15, wherein the adjustment pinion defines an internal cavity and the adjustment nut is disposed within the internal cavity.

17. The tool of claim 16, further comprising a rear trip member axially translatable along the second axis relative to the adjustment pinion, the adjustment pinion being rotatable relative to the rear trip member, wherein a forward portion of the rear trip member abuts the adjustment nut within the internal cavity of the adjustment pinion.

18. The tool of claim 15, wherein the forward trip member and the adjustment nut are threadably engaged by a set of left-handed threads.

19. The tool of claim 15, wherein the first and second geared portions are bevel gears.

* * * * *